US007201673B2

(12) United States Patent
Sasaki

(10) Patent No.: US 7,201,673 B2
(45) Date of Patent: Apr. 10, 2007

(54) BALL

(75) Inventor: Hiroto Sasaki, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/133,390

(22) Filed: May 20, 2005

(65) Prior Publication Data

US 2005/0261085 A1 Nov. 24, 2005

(30) Foreign Application Priority Data

May 24, 2004 (JP) ..... 2004-153019

(51) Int. Cl.
*A63B 37/12* (2006.01)

(52) U.S. Cl. ..... 473/378

(58) Field of Classification Search ..... 473/351, 473/378

See application file for complete search history.

(56) References Cited

U.S. PATENT DOCUMENTS 6,063,859 A 5/2000 Yamamoto et al.
6,312,347 B1 * 11/2001 Keller ..... 473/371
2003/0187152 A1 10/2003 Shimura et al.
2005/0271881 A1 * 12/2005 Hong ..... 428/423.1
2006/0030663 A1 * 2/2006 Andre et al. ..... 524/588
2006/0089419 A1 * 4/2006 Hogge et al. ..... 522/174

FOREIGN PATENT DOCUMENTS

JP 8-206255 A 8/1996
JP 10-234884 A 9/1998

* cited by examiner

*Primary Examiner*—Raeann Gorden
*Assistant Examiner*—Raeann Trimiew
(74) *Attorney, Agent, or Firm*—Sughrue Mion, PLLC

(57) ABSTRACT

A ball composed of a ball body and a single- or multi-layered coating film covering the ball body, wherein the coating film includes a coating layer having good scratch or scuff resistance and high resilience. The ball keeps a good appearance even after repeated hitting because of its good scratch or scuff resistance and its ability to repair scratches automatically with the lapse of time even though it is temporarily damaged.

8 Claims, No Drawings

BALL

CROSS-REFERENCE TO RELATED APPLICATION

This non-provisional application claims priority under 35 U.S.C. §119(a) on Patent Application No. 2004-153019 filed in Japan on May 24, 2004, the entire contents of which are hereby incorporated by reference.

BACKGROUND OF THE INVENTION

The present invention relates to a ball excelling in surface durability.

Balls for golf, park golf, ground golf, and gate ball usually have a coating film for their surface protection and good appearance. Such coating film is required to have not only good appearance but also good resistance to impact and wear resulting from repeated hitting by clubs or sticks.

A coating material to meet this requirement is disclosed in JP-A 8-206255. It is composed of acrylpolyol, polyester polyol (or fatty acid modified product thereof), and hardener. It forms a coating film which protects golf balls from damage by bunker shots. Another coating material to improve durability of golf balls is disclosed in JP-A 10-234884 and JP-A 2003-253201.

These conventional coating materials, however, are not entirely satisfactory. Even though they form an impact- and wear-resistant coating film on golf balls, the coating film is subject to scratch which propagates to deteriorate the ball's appearance. So, there has been a demand for golf balls which keep their good appearance even after repeated hitting by clubs or sticks.

SUMMARY OF THE INVENTION

The present invention was completed in view of the foregoing. It is an object of the present invention to provide a ball which keeps a good appearance even after repeated hitting because of its good scratch or scuff resistance and its ability to repair scratches automatically with the lapse of time even though it is temporarily damaged.

As the result of their extensive studies, the present inventors found that the above-mentioned object is achieved by a ball composed of a ball body and a single- or multi-layered coating film covering the ball body, wherein the coating film includes a layer having good scratch or scuff resistance and high resilience. This finding led to the present invention.

The first aspect of the present invention is directed to a ball composed of a ball body and a single- or multi-layered coating film covering the ball body, wherein the coating film includes a coating layer having good scratch or scuff resistance and high resilience.

The second aspect of the present invention is directed to the ball as defined above in which the coating layer having good scratch or scuff resistance and high resilience is one which is formed from any of a coating compound containing polydimethylsiloxane copolymer, polycaprolactone, and polysiloxane, a coating compound containing polydimethylsiloxane copolymer whose skeleton has polycaprolactone and polysiloxane introduced thereinto, a coating compound containing polydimethylsiloxane copolymer whose skeleton has polycaprolactone introduced thereinto and polysiloxane, and a coating compound containing polydimethylsiloxane copolymer whose skeleton has polysiloxane introduced thereinto and polycaprolactone.

The third aspect of the present invention is directed to the ball as defined above which is intended for golf, park golf, ground golf, and gate ball.

The ball according to the present invention keeps its good appearance even after repeated hitting.

DETAILED DESCRIPTION OF THE PREFERRED EMBODIMENTS

The invention will be described below in more detail with reference to its preferred embodiments.

The ball according to the present invention is composed of a ball body and a single- or multi-layered coating film covering the ball body. It is characterized in that the coating film includes a coating layer having good scratch or scuff resistance and high resilience.

The term "a coating layer having good scratch or scuff resistance and high resilience" as used in the present invention implies a coating layer which repairs its scratches by itself with the lapse of time even when it is damaged slightly by scratches or dents. This function is ascribed to the good resilience of the coating film.

The coating film varies in resilience and the self-repairing function relies on resilience. Resilience depends on the molecular structure of the block copolymer including soft segments and hard segments. Hard segments form crystalline domains and soft segments form amorphous domains. Crystalline domains function as crosslinking sites (which prevent amorphous domains from plastic deformation). Thus, the coating film as a whole exhibits resilience, and the degree of resilience varies depending on the kind and composition of monomer units constituting the block copolymer and also on the arrangement of monomer units in the polymer chains.

There are no restrictions on the coating compound which forms the above-mentioned coating film having scratch or scuff resistance and high resilience. It may be selected from clear resins based on polyacrylate, polyurethane, polycarbonate, polystyrene, polyester, silicone, and fluoroplastics, in the form of homopolymer, copolymer, or blend. Its typical examples are listed below.

(1) One containing polydimethylsiloxane copolymer, polycaprolactone, and polysiloxane.
(2) One containing polydimethylsiloxane copolymer whose skeleton has polycaprolactone and polysiloxane introduced thereinto.
(3) One containing polydimethylsiloxane copolymer whose skeleton has polycaprolactone introduced thereinto and polysiloxane.
(4) One containing polydimethylsiloxane copolymer whose skeleton has polysiloxane introduced thereinto and polycaprolactone.

Each of the coating compounds (1) to (4) listed above contains polydimethylsiloxane copolymer (A), polycaprolactone (B), and polysiloxane (C). Each of polycaprolactone (B) and polysiloxane (C) may be present in the skeleton of dimethylpolysiloxane copolymer (A) or may be present separately in the coating compound.

The polydimethylsiloxane copolymer (A) mentioned above should preferably be a copolymer composed of polydimethylsiloxane segments and polymer chains formed from vinyl monomers. It may also be a block copolymer or a graft copolymer.

Examples of the vinyl monomer mentioned above include methyl acrylate, ethyl acrylate, n-butyl acrylate, isobutyl acrylate, octyl acrylate, cyclohexyl acrylate, tetrahydrofurfuryl acrylate, methyl methacrylate, ethyl methacrylate, n-butyl methacrylate, isobutyl methacrylate, 2-ethylhexyl methacrylate, stearyl methacrylate, lauryl methacrylate, methyl vinyl ether, ethyl vinyl ether, n-propyl vinyl ether, n-butyl vinyl ether, isobutyl vinyl ether, styrene, α-methylstyrene, acrylonitrile, methacrylonitrile, vinyl acetate, vinyl chloride, vinylidene chloride, vinyl fluoride, vinylidene fluoride, glycidyl acrylate, glycidyl methacrylate, acryl glycidyl ether, acrylic acid, methacrylic acid, itaconic acid, crotonic acid, maleic acid, maleic anhydride, citraconic acid, acrylamide, methacrylamide, N-methylol acrylamide, N,N-dimethylacrylamide, N,N-dimethylaminoethyl methacrylate, N,N-diethylaminoethyl methacrylate, and diacetoneacrylamide. Additional examples include vinyl monomers having OH group, such as 2-hydroxyethyl acrylate, 2-hydroxyethyl methacrylate, 2-hydroxypropyl acrylate, 2-hydroxypropyl methacrylate, and allyl alcohol. Another example is a reaction product of Cadura E with any of acrylic acid, methacrylic acid, itaconic acid, crotonic acid, and maleic acid.

Examples of the polycaprolactone (B) mentioned above include difunctional polycaprolactone, trifunctional polycaprolactone, and tetrafunctional polycaprolactone.

Examples of the polysiloxane (C) mentioned above include polymers of partial hydrolyzate of silane compound having hydrolyzable silyl groups or addition products obtained by adding the radical-polymerizable silane compound mentioned above to organosilica sol (which is a stable dispersion of silicon dioxide fine powder in an organic solvent). The silane compound is exemplified by tetramethoxysilane, tetraethoxysilane, methyltrimethoxysilane, methyltriethoxysilane, dimethyldimethoxysilane, dimethyldiethoxysilane, γ-glycidoxypropyltrimethoxysilane, γ-glycidoxypropyltriethoxysilane, γ-glycidoxypropylmethyldimethoxysilane, γ-glycidoxypropylmethyldiethoxysilane, γ-methacryloxypropyltrimethoxysilane, γ-methacryloxytriethoxysilane, γ-methacryloxypropylmethyldimethoxysilane, γ-methacryloxypropylmethyldiethoxysilane, γ-acryloxypropylmethyltrimethoxysilane, and γ-acryloxypropylmethyldimethoxysilane.

Incidentally, introduction of the polycaprolactone (B) and/or the polysiloxane (C) into the skeleton of the polydimethylsiloxane copolymer (A) may be accomplished by copolymerization for the polydimethylsiloxane copolymer (A) in the presence of the polycaprolactone (B) and/or the polysiloxane (C).

The content of polydimethylsiloxane should preferably be 0.5 to 35 wt % in the polydimethylsiloxane copolymer (A) including polycaprolactone (B) and/or polysiloxane (C) connected to the molecule thereof. The polydimethylsiloxane moiety protects the surface of the coating film from scratches by its lubricating action to reduce the coefficient of friction.

The content of polycaprolactone (B) should preferably be 2 to 60 wt % in the solids of the coating material. Polycaprolactone (B) imparts high resilience to the coating film, thereby allowing the coating film to absorb external force applied thereto.

The content of polysiloxane (C) should preferably be 0.5 to 25 wt % in the solids of the coating material. Polysiloxane (C) imparts stain resistance, weather resistance, and heat resistance to the coating film and increases the surface hardness of the coating film.

The coating compound composed of the components (1) to (4) mentioned above may be cured by using a crosslinking agent which is capable of urethane-crosslinking and/or melamine-crosslinking the polydimethylsiloxane copolymer (A) including polycaprolactone (B) and/or polysiloxane (C) connected to the skeleton thereof. Examples of the urethane-crosslinking agent include polyisocyanate and blocked-polyisocyanate, such as methylene-bis-4-cyclohexylisocyanate, trimethylolpropane adduct of tolylene diisocyanate, trimethylolpropane adduct of hexamethylene diisocyanate, trimethylolpropane adduct of isophoronediisocyanate, isocyanurate of tolylene diisocyanate, isocyanurate of hexamethylene diisocyanate, isocyanurate of isophorone diisocyanurate, and biuret of hexamethylene diisocyanate. Examples of the melamine cross-linking agent include alkoxymethylol melamine.

Any commercial product may be used as the coating compound that gives rise to a coating film having scratch or scuff resistance and high resilience. It is available from Natoko Paint Co., Ltd. under a trade name of "Self-repairable clear", which is a special coating compound based on acrylic resin.

The coating compound used to form the coating film on the ball body may optionally be incorporated with any known paint additives listed below.

- Leveling agent, such as Disparlon L-1980-50 (from Kusumoto Chemicals, Ltd.)
- UV light absorber, such as Tinuvin-P (from Ciba Specialty Chemicals K.K.) and ASL-23 (Shonan Kagaku)
- Fluorescent brightening agent, such as Ubitex OB (from Ciba Specialty Chemicals K.K.), Hostalux KSN (from Hoechst Japan, Ltd.), and Hakkol Py-1800 (from Hakkol Chemical Co., Ltd.)
- Slip agent, such as Disparlon 1711 (from Kusumoto Chemicals, Ltd.) and Granol450 (from Kyoeisha Chemical Co., Ltd.)
- Light stabilizer, such as Adekastab LA-77 (from Asahi Denka Co., Ltd.) and Tinuvin 622LD (from Ciba Specialty Chemicals K.K.)
- Curing catalyst, such as dibutyltin dilaurate, lead naphthenate, lead octylate, aluminum chelates, and tertiary amines.
- Antifoaming agent, such as Disparlon OX-710 (from Kusumoto Chemicals, Ltd.)
- Thickening agent, such as Disparlon AS-415 (from Kusumoto Chemicals, Ltd.)
- Coloring pigment, such as titanium dioxide.
- Plasticizer, such as dioctyl phthalate, dioctyl adipate.

It may also be incorporated with other resins such as polyester polyol and polyether polyol.

The coating compound may be used as an enamel coating compound after incorporation with pigments or as a clear coating compound without pigments.

The ball body may be constructed in any manner or with any material which will not impair the features of the present invention.

The ball body to which the coating compound mentioned above is applied may be formed in any manner or from any material which will not impair the features of the present invention. For example, the ball of the present invention may be a golf ball of one-piece type or multi-piece type (the latter being constructed of a core and one or more layers covering the core). The core is not specifically restricted and it may be formed in the usual way from ordinary materials. The one-piece golf ball may be formed from vulcanized rubber or thermoplastic or thermosetting elastomer.

The cover layer may be formed from any thermoplastic resin which is ordinarily used for cover layers of golf balls. Such thermoplastic resins are exemplified by ionomer resin, polyester elastomer, polyurethane elastomer, and mixtures thereof, the first one being most desirable. The ionomer resin can be obtained by compounding an ethylene-unsaturated carboxylic acid copolymer (as a base resin) with a metal compound that provides cations.

The ethylene-unsaturated carboxylic acid constituting the ionomer resin includes copolymers of ethylene with a $C_{3-6}$ unsaturated carboxylic acid, such as acrylic acid, methacrylic acid, maleic acid, fumaric acid, and vinyl benzoate.

The cation-proving metal compound constituting the ionomer resin includes alkali metal compounds or alkaline earth metal compounds in the form of formate, acetate, nitrate, carbonate, hydrogen carbonate, oxide, hydroxide, and alkoxide. Such metals include Na, Zn, Li, Mg, Mn, Ca, Co, and K.

The cover material may be selected from commercial ones. Commercial ionomer resins include Himilan 1605, 1706, 1707, AM7315, AM7311, AM7318 and Nucrel AN4311 (from Du Pont-Mitsui Polychemicals Co., Ltd.) and Surlyn 7930, 6320 (from Du Pont). Commercial polyester elastomers include Hytrel 4047, 4767 (from Du Pont-Toray Co., Ltd.). Commercial polyurethane elastomers include Pandex (from Dainippon Ink and Chemicals, Incorporated).

The cover layer mentioned above usually has a Shore D hardness of 35 to 65. With an excessively low hardness, it will not contribute to high resilience, and with an excessively low hardness, it will not contribute to good feel and good spin performance. The cover layer usually has a thickness of 0.5 to 3 mm.

In the case where the ball of the present invention is intended for park golf, ground golf, and gate ball, the ball body may be of solid structure or hollow structure. In addition, it may be of single-layer structure or multi-layer structure or multi-piece structure composed of a core and one or more outer layers. Dual-layer structure is desirable for hollow balls.

The solid ball or core mentioned above may be formed mainly from a thermoplastic resin such as polypropylene, polyethylene, ionomer resin, and urethane elastomer. They may be used alone or in combination with one another.

The cover layer on the core or the outer layer for the hollow ball of dual-layer structure may be formed mainly from polypropylene, polyethylene, ionomer resin, and urethane elastomer, alone or in combination, as in the case of the core.

According to the present invention, the coating film covering the ball body is composed of one layer or more than one layer, and it includes a layer which exhibits scratch or scuff resistance and high resilience.

The layer which exhibits scratch or scuff resistance and high resilience may be in contact with the surface layer (outermost layer) of the ball body or may be in contact with the enamel coating layer which has been formed on the surface layer (outermost layer) of the ball body. Incidentally, the layer which exhibits scratch or scuff resistance and high resilience should preferably be formed on its underlying surface which has previously undergone surface treatment for good adhesion. The surface treatment includes corona treatment, plasma treatment, UV light irradiation, electron beam irradiation, and primer coating.

The layer which exhibits scratch or scuff resistance and high resilience may be formed by any coating method, such as brush coating, spray coating, and electrostatic coating, which is usually employed to form the surface layer on balls.

The layer which exhibits scratch or scuff resistance and high resilience usually has a thickness of 1 to 50 μm, preferably 10 to 30 μm.

The layer which exhibits scratch or scuff resistance and high resilience should have a thickness which accounts for no less than 5%, preferably no less than 10%, and more preferably no less than 20%, of the total thickness of single layer or multiple layers covering the ball body. It will be poor in scratch or scuff resistance if it fails to meet this requirement.

Incidentally, the total thickness of the single layer or multiple layers covering the ball body is usually 5 to 100 μm, preferably 10 to 70 μm.

The ball according to the present invention is suitable for golf, park golf, ground golf, and gate ball. Its diameter and weight should conform to their respective game rules. Thus, the diameter and weight of the core and the thickness and weight of the outer layer should be properly determined accordingly. The ball for golf should meet the Golf Rules, which stipulates that the diameter should be no smaller than 42.67 mm and the weight should be no less than 45.93 g, preferably 45.0 to 45.93 g. The ball for park golf should meet the rule of the International Park Golf Association, which stipulates that the diameter should be 6 cm and the weight should be 80 to 95 g, with the core diameter being about 4 to 5 cm and the core weight being about 25 to 45 g. Incidentally, the ball for park golf may have a cover layer whose color is selected from white, red, blue, yellow, orange, and pink.

Being covered with a coating layer which has scratch or scuff resistance and high resilience, the ball according to the present invention is hardly subject to scratch on account of the coating film formed thereon. This feature is attributable to the lubricating property of the outermost layer of the coating film which relieves external forces and also to the high resilience of the coating film which rapidly cures damage by itself.

EXAMPLES

The invention will be described in more detail with reference to the following examples, which are not intended to restrict the scope thereof.

Preparation of Coating Compound 1

Tetraethoxysilane (320 pbw) was mixed with ethanol (106 pbw), deionized water (21 pbw), and 1% hydrochloric acid (1 pbw). The resulting solution was allowed to stand at 85° C. for 2 hours and then gradually heated, during which ethanol was recovered. The solution was kept at 180° C. for 30 minutes and then cooled. Thus there was obtained viscous polysiloxane (1).

VPS-0501 (20 pbw) was mixed with toluene (50 pbw), methyl isobutyl ketone (50 pbw), methyl methacrylate (30 pbw), butyl methacrylate (26 pbw), 2-hydroxyethyl methacrylate (23 pbw), methacrylic acid (1 pbw), and 1-thioglycerin (0.5 pbw). VPS-0501 is a polymerization initiator containing polydimethylsiloxane units, available from Wako Pure Chemical Industries, Ltd. The resulting mixture was allowed to react at 80° C. for 8 hours. Thus there was obtained polydimethylsiloxane block copolymer (1), which contains 50% solids and has a Gardner-Holtz viscosity of X.

Coating compound (1) was prepared by mixing together 75 pbw of the block copolymer (1), 10 pbw of the polysiloxane (1) mentioned above, 15 pbw of "Plaxel 308", and 36 pbw of "Tekenate D-170N". "Plaxel 308" is polycaprolactone having a molecular weight of 850 and an OH value of 195 KOH mg/g, available from Daicel Chemical Industries, Ltd. "Takenate D-170N" is HMDI isocyanurate as a crosslinking agent containing 100% solids and 20.7% NCO, available from Takeda Pharmaceutical Co., Ltd.

Preparation of Coating Compound 2

A mixture of 1,3-cyclohexanedicarboxylic acid (138.0 pbw), adipic acid (157.0 pbw), trimethylolpropane (140.0 pbw), neopentylglycol (65.0 pbw), 1,4-cyclohexanedimethanol (58.0 pbw), and diethylene glycol (30.0 pbw) was heated at 200 to 240° C. for 5 hours to give a polyester having an acid value of 4, a hydroxyl value of 170, and a weight-average molecular weight of 15,000. The resulting polyester was dissolved in a 1:1 mixed solvent of xylene and MIBK (methyl isobutyl ketone). Thus there was obtained varnish (1) containing 70 wt % of nonvolatile matter.

Coating compound (2) was prepared by mixing 100 pbw of varnish (1) with 75 pbw of "Takenate D-160N", 0.005 pbw of dibutyltin dilaurate as a curing catalyst, and 250 pbw of solvent. "Takenate D-160N" is an adduct of hexamethylenediisocyanate as a non-yellowing polyisocyanate, containing 50 wt % solids and 8.5 wt % NCO, available from Takeda Pharmaceutical Co., Ltd. The solvent is a 2:3:5 mixture (by weight) of butyl acetate, MIBK, and propylene glycol monomethyl ether acetate (PMA).

Preparation of Coating Compound 3

A mixture of "Plaxel FM-3" (200 pbw), methyl methacrylate (645 pbw), 2-hydroxyethyl methacrylate (155 pbw), 2-hydroxyethyl methacrylate (155 pbw), 2,2'-azobisisobutyronitrile (15 pbw), and methyl isobutyl ketone (100 pbw) was added dropwise over 4 hours to a mixed solvent of butyl acetate (500 pbw) and methyl isobutyl ketone (300 pbw) which had been heated to 110° C. "Plaxel FM-3" is a polyester-containing acryl monomer, available from Daicel Chemical Industries, Ltd. The reacting mixture was kept at 110° C. for 1 hour. To the reacting mixture was added dropwise over 1 hour 2,2'-azobisisobutyronitrile (5 pbw) dissolved in methyl isobutyl ketone (100 pbw). The reacting mixture was kept at 110° C. for 3 hours. Thus there was obtained coating compound (3) which was characterized as follows. Solids content: 50.5%

Viscosity: 1200 mPa.s (25° C.)

Number-average molecular weight: 7,000

Hydroxyl value: 89 mg KOH/g (based on solids)

Polyester content: 14 wt % (based on solids)

Example 1 and Comparative Examples 1 and 2

A rubber compound of the following formulation was prepared.

Cis-1,4-polybutadiene (BR01, from JSR Corporation): 100 pbw

Zinc acrylate: 24 pbw

Zinc oxide: 19 pbw

Antioxidant "Nocrac NS-6" from Ouchishinko Chemical Industrial Co., Ltd.: 1 pbw

Dicumyl peroxide: 1 pbw

The rubber compound was milled at 50–90° C. by using milling rolls and then vulcanized at 160° C. for 15 minutes to form cores (38.5 mm in diameter) for two-piece golf balls.

A resin compound for the cover layer was prepared from 100 pbw each of Himilan 1605 and Himilan 1706 (both from Du Pont-Mitsui Polychemicals Co., Ltd.) and 2 pbw of titanium oxide by mixing in a kneader (made by Moriyama Seisakusho, K.K.). The resin compound was injection-molded onto the surface of the core. Thus there was obtained a two-piece golf ball body (42.8 mm in diameter).

The surface of the golf ball body was coated by spraying with each of the coating compounds (1) to (3) prepared as mentioned above. The coating layer was 10 μm thick. The thus obtained golf balls were tested for characteristic properties. The results are shown in Table 1.

TABLE 1

| | | | Example | Comparative Example | |
|---|---|---|---|---|---|
| Coating compound | | | 1 (1) | 1 (2) | 2 (3) |
| Characteristic properties | Brush test | Immediately after test | Scratches are found | Scratches are found | Scratches are found |
| | | 10 seconds after test | Scratches disappeared | Scratches remained | Scratches remained |
| | Abrasion test | Scratches | ○ | Δ | Δ |
| | | Gloss | ○ | ○ | ○ |
| | Weather resistance | | ○ | ○ | ○ |
| | Adhesion test | | ○ | ○ | ○ |

Brush Test

The sample ball was rubbed three times with a brass brush and then examined for scratches immediately after rubbing and 10 seconds after rubbing.

Abrasion Test

A 4-liter porcelain pot mill was charged with ten sample balls and 1.5 liters of abrasive (Shorel Nugget, from Showa Denko K.K.). After mixing for 2 hours, the sample balls were examined for scratches and gloss. The criterion for rating is as follows.

Scratches:

○: Few scratches

Δ: Some scratches

Gloss:

○: No decrease in gloss

Weather Resistance:

The sample balls were exposed for 200 hours in a sunshine weather-o-meter and then visually examined for the appearance of the coating film. The criterion for rating is as follows.

○: No change in color

Adhesion

The sample balls were hit 100 times at a head speed of 45 m/s by a driver attached to a hitting machine (made by True Temper Co., Ltd.). After hitting, they were visually examined for the appearance of the coating film. The criterion for rating is as follows.

○: No peeling of coating film

Japanese Patent Application No. 2004-153019 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A ball composed of a ball body and a single- or multi-layered coating film covering said ball body, wherein said coating film includes a coating layer having good scratch or scuff resistance and high resilience, and wherein the coating layer having good scratch or scuff resistance and high resilience is formed from any of:

(A) a coating compound containing (i) polydimethylsiloxane copolymer, (ii) polycaprolactone, and (iii) polysiloxane;

(B) a coating compound containing polydimethylsiloxane copolymer with a skeleton into which polycaprolactone and polysiloxane are introduced;

(C) a coating compound containing (i) polydimethylsiloxane copolymer with a skeleton into which polycaprolactone is introduced and (ii) polysiloxane; and (D) a coating compound containing (i) polydimethylsiloxane copolymer with a skeleton into which polysiloxane is introduced and (ii) polycaprolactone.

2. The ball of claim 1, which is intended for golf, park golf, ground golf, and gate ball.

3. The ball of claim 1, wherein the content of polydimethylsiloxane in the polydimethylsiloxane copolymer of coating compound (B), (C), or (D) is 0.5 to 35 wt %, based on the total weight of the polydimethylsiloxane copolymer.

4. The ball of claim 1, wherein the content of polysiloxane is 0.5 to 25 wt % of the coating compound.

5. The ball of claim 1, wherein the coating compound is as an enamel coating compound or a clear coating compound.

6. The ball of claim 1, wherein the coating layer is formed by a coating method selected from the group consisting of brush coating, spray coating, and electrostatic coating.

7. The ball of claim 1, wherein the coating layer has a thickness of 1 to 50 μm.

8. The ball of claim 1, wherein the total thickness of the single layer or multiple layers of the coating film covering the ball body is 5 to 100 μm.

* * * * *